US007140448B2

(12) United States Patent
Estes et al.

(10) Patent No.: US 7,140,448 B2
(45) Date of Patent: Nov. 28, 2006

(54) STEPPED POLYCRYSTALLINE DIAMOND COMPACT INSERT

(75) Inventors: Roy Estes, Weatherford, TX (US); Johnny Castle, Weatherford, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 11/151,766

(22) Filed: Jun. 14, 2005

(65) Prior Publication Data

US 2005/0279534 A1 Dec. 22, 2005

Related U.S. Application Data

(63) Continuation of application No. 10/600,662, filed on Jun. 20, 2003, now Pat. No. 6,904,984.

(51) Int. Cl.
*E21B 10/36* (2006.01)

(52) U.S. Cl. ..... 166/430; 166/432

(58) Field of Classification Search ..... 175/426, 175/428, 430, 432, 434
See application file for complete search history.

(56) References Cited

U.S. PATENT DOCUMENTS

| | | | | |
|---|---|---|---|---|
| 4,254,840 | A | | 3/1981 | Shay, Jr. |
| 4,385,669 | A | | 5/1983 | Knutsen |
| 5,184,689 | A | | 2/1993 | Sheirer et al. |
| 5,467,837 | A | | 11/1995 | Miller et al. |
| 5,575,342 | A | | 11/1996 | Hedlund et al. |
| 5,647,449 | A | * | 7/1997 | Dennis ..... 175/434 |
| 5,709,279 | A | | 1/1998 | Dennis |
| 5,816,347 | A | | 10/1998 | Dennis et al. |
| 6,003,623 | A | * | 12/1999 | Miess ..... 175/430 |
| 6,098,730 | A | | 8/2000 | Scott et al. |
| 6,148,938 | A | | 11/2000 | Beaton |
| 6,202,770 | B1 | | 3/2001 | Jurewicz et al. |
| 6,234,261 | B1 | | 5/2001 | Evans et al. |
| 6,315,066 | B1 | | 11/2001 | Dennis |
| 6,386,302 | B1 | | 5/2002 | Beaton |
| 6,401,845 | B1 | | 6/2002 | Fielder |
| 6,408,959 | B1 | | 6/2002 | Bertagnolli et al. |
| 6,484,825 | B1 | | 11/2002 | Watson et al. |
| 6,604,588 | B1 | | 8/2003 | Eyre et al. |
| 6,904,984 | B1 | * | 6/2005 | Estes et al. ..... 175/430 |
| 2002/0084112 | A1 | * | 7/2002 | Hall et al. ..... 175/426 |
| 2002/0108790 | A1 | * | 8/2002 | Eyre et al. ..... 175/431 |
| 2003/0037964 | A1 | | 2/2003 | Sinor et al. |
| 2003/0111273 | A1 | | 6/2003 | Richert et al. |

* cited by examiner

*Primary Examiner*—William Neuder
(74) *Attorney, Agent, or Firm*—Storm LLP; John G. Fischer

(57) ABSTRACT

The present invention addresses this need in the art by providing a cutter insert comprising a plug section and a cutter pedestal. The cutter insert is preferably formed of tungsten carbide, except for two exterior surfaces covered with PDC. The plug section may be circular or oval in cross section perpendicular to the axis of the insert. The plug section and the pedestal each defines a shoulder which is coated with a PDC layer. In this way, two cutting surfaces are applied to the formation, enhancing the cutting ability of the insert.

5 Claims, 4 Drawing Sheets

STEPPED POLYCRYSTALLINE DIAMOND COMPACT INSERT

CROSS REFERENCE TO A RELATED APPLICATION

This application is a continuation of U.S. patent application Ser. No. 10/600,662 entitled "STEPPED POLYCRYSTALLINE DIAMOND COMPACT INSERT," filed on Jun. 20, 2003 now U.S. Pat. No. 6,904,984 for inventors/applicants Roy Estes and Jack Castle, wherein each related application is incorporated by reference herein for all purposes.

FIELD OF THE INVENTION

The present invention relates generally to earth boring drill bits, and in particular to a polycrystalline diamond compact (PDC) insert exhibiting a stepped profile structure for use in a fixed cutter earth boring bit or reamer.

BACKGROUND OF THE INVENTION

PDC inserts are commonly used to increase the wear resistance of surfaces in certain types of downhole tools. For example, inserts on a reamer, in association with a drill bit, are used on outer blade surfaces to resist wear from the bore hole wall. The reamer enlarges the bore hole to a diameter larger than that created by the drill bit.

The function of the reamer is to maintain the diameter of the hole as the drill bit proceeds downwardly through the rock formation. As the bore hole is being drilled, the rock drill bit gradually wears to undersize and thus the hole which is cut gradually becomes of undersize diameter. The function of the reamer, which typically has PDC inserts along the outer blade edge, is to grind the circumference of the hole, shortly after it has been cut by the rock drill bit, and thus keep the hole diameter to size.

Inserts are also commonly used in fixed cutter drill bits along a cutting blade which is stationary in respect of the drill string, in contrast to roller cone bits. Such a fixed cutter drill bit typically has a leading face from which a plurality of blades extend, each blade carrying a plurality of cutting elements comprising PDC inserts. Inserts may also be placed along a gauge pad at the extreme outer diameter of each blade.

PDC inserts have a polycrystalline diamond surface formed on wear surfaces, which may be formed in a variety of ways, principally in a conventional process under heat and pressure, or by sintering. The inserts are formed of a tungsten carbide material, and the wear surface is then applied. In the past, such inserts commonly have had a flat or slightly ovoid outer contact region, where the insert contacts the rock formation being cut. Regardless of the configurations of the inserts, they have all had a characteristic in common, and that is the inserts define one point, line, or area contact with the rock formation. As the rock formation increases in hardness, the resistance or "work load" necessary to disintegrate the formation at that area also increases. The increased resistance causes two common problems. The increased resistance on individual inserts can cause premature chipping or breakage failure of the inserts. Also, the combined increase of resistance on all the PDC inserts increases the amount of torque required to drive the bit and causes the bit to stop momentarily while drilling, a condition known as "stick slip" drilling. There is a present need in this art for PDC inserts that can drill harder formations with less risk of failure and with less risk of "stick slip". The present invention is directed to this need in the art.

SUMMARY OF THE INVENTION

The present invention addresses both of these noted problems in the art by providing a PDC insert comprising a plug section and a pedestal section. The cutter insert is preferably formed of tungsten carbide, except for two exterior surfaces covered with PDC. The plug section may be circular or oval in cross section perpendicular to the axis of the insert. The plug section and the pedestal each defines a shoulder which is coated with a PDC layer. In one preferred embodiment of the invention, the pedestal section provides a second smaller cutting area or edge which precedes the cutting area of the plug. This leading cutting edge cuts a narrow groove in the formation just ahead of the larger plug cutting area. This narrow groove reduces the rock strength of the formation cut by the plug surface and obviously reduces the amount of rock cut by the plug surface. Dividing the work load over two edges reduces the load per edge resulting in less risk of PDC failure.

In another preferred embodiment, the pedestal section is designed to limit the depth that the plug edge can embed into the rock formation. As additional weight is applied to a PDC bit during normal operation, the PDC inserts are forced to embed deeper into the formation. As the inserts embed deeper, work load is increased and this results in more torque being required to turn the bit. As previously described, at some point, the torque reaches a level causing a "stick slip" drilling condition. "Stick slip" drilling is very detrimental to PDC bits often resulting in premature failure of the bits.

The deeper embedding of the insert into the formation also causes many other problems with the drill string and rig. The pedestal of the present invention is designed to slide across the formation rather than embed and cut the formation. This action limits the depth which the plug edge can embed into the formation. In the additional embodiment of the invention, the amount of embedding of the plug edge remains about the same even as the WOB (weight on bit) is increased substantially. Limiting the amount of embedding of the inserts limits the amount of torque required to rotate the bit and reduces the risk of "stick slip" drilling and all the problems associated with it.

Thus, the present invention is directed to improving PDC drilling in harder formations. These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, a more particular description of the invention, briefly summarized above, may be had by reference to embodiments thereof which are illustrated in the appended drawings.

DETAILED DESCRIPTION OF A PREFERRED EMBODIMENT

Figure 1:
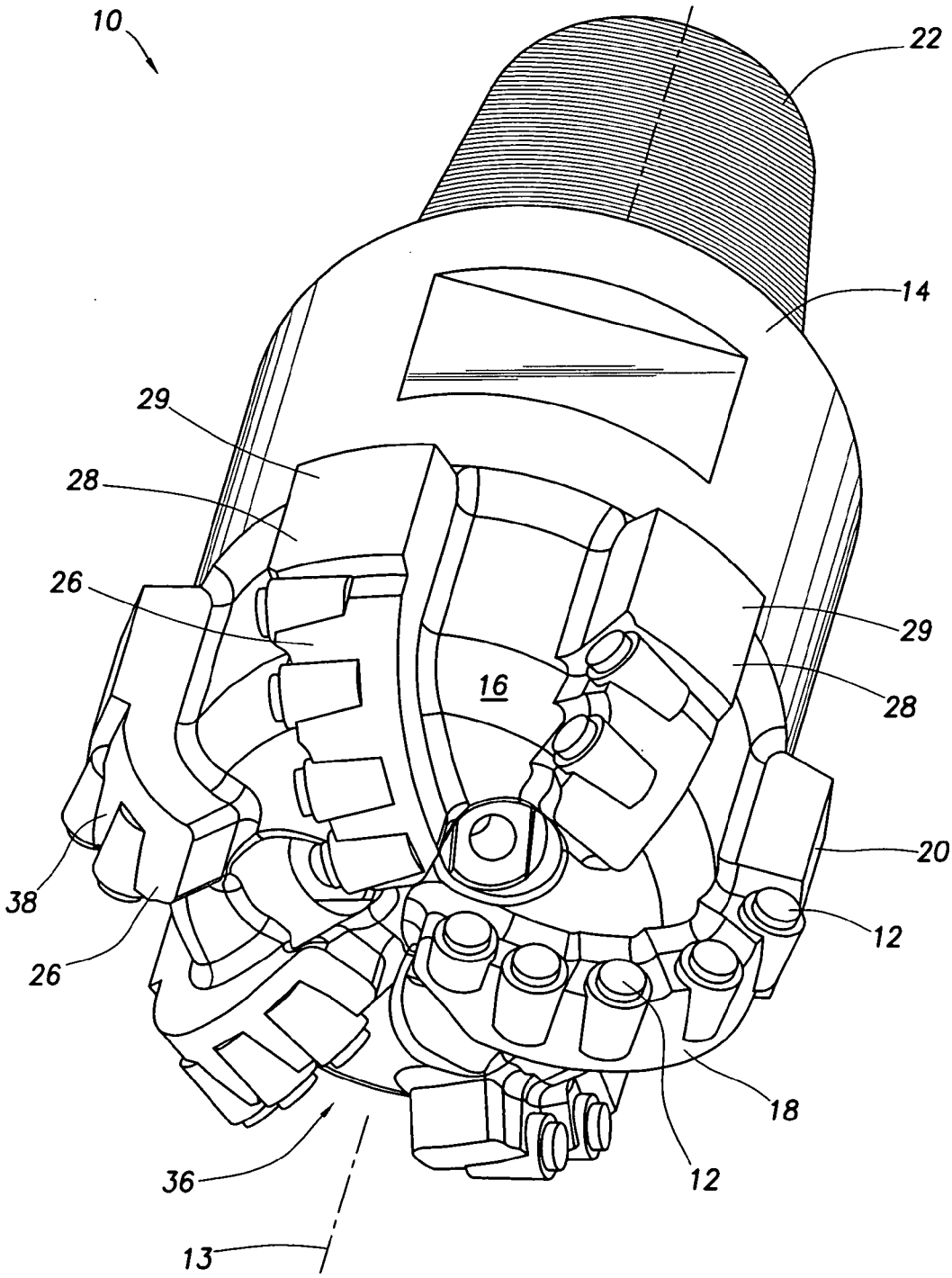
FIG. 1 is a perspective view of a fixed cutter bit wherein the PDC insert of the present invention finds application.

FIG. 1 shows a fixed cutter drill bit 10 including cutter inserts 12 of the present invention. The drill bit 10 has a central axis of rotation 13 and a bit body 14 having a leading face 16, an end face 18, a gauge region 20, and a shank 22 for connection to a drill string (not shown). A plurality of blades 26 extend from the leading face 16 of the bit body away from the central axis of rotation 13 of the bit 10. Each blade 26 terminates in a gauge pad 28 having a gauge surface 29 which faces a wall 30 of a borehole (not shown).

A number of cutter inserts 12 are mounted on the blades 26 at the end face 18 of the bit 10 in both a cone region 36 and a shoulder region 38 of the end face 18. Each cutter 12 partially protrudes from its respective blade 26 and the cutter inserts are spaced apart along the blade 26, typically in a given manner to produce a particular type of cutting pattern. The structure of the cutter insert of the invention is shown in greater detail in FIGS. 3, 4, and 5, below.

Figure 2:
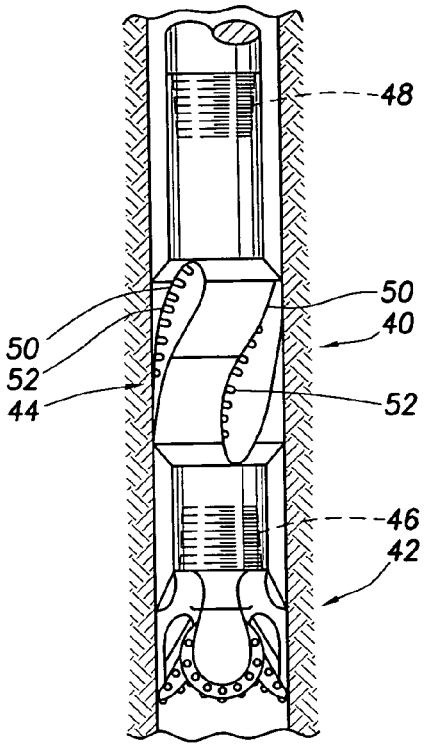
FIG. 2 is an elevation view of a reamer on a rotary cone drill bit wherein the PDC insert of the present invention finds application.

The cutter insert of the invention also may find application in a reamer 44 as shown in the reaming assembly 40 shown in FIG. 2. The reamer 44 follows a roller cone bit 42 of conventional design and a reamer section 44. The roller cone bit 42 may be joined to the reamer section 44 with a threaded connection 46 and another threaded connection 48 is provided to join the reamer section to a drill string (not shown). The reamer section includes a plurality of blades 50 and each blade includes a plurality of cutter inserts 52, constructed in accordance with the teachings of this invention, as will now be described.

Figure 3:
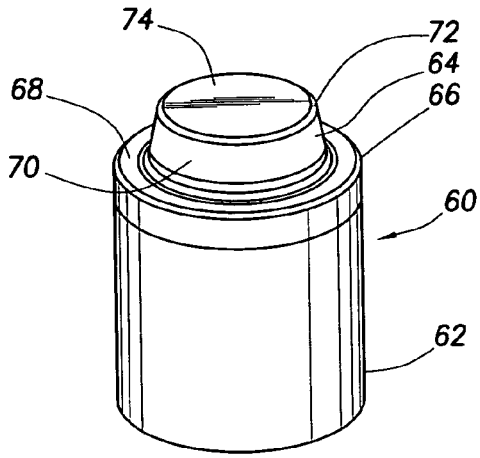
FIG. 3 is a perspective view of a presently preferred embodiment of a PDC insert of the invention.
Figure 4:
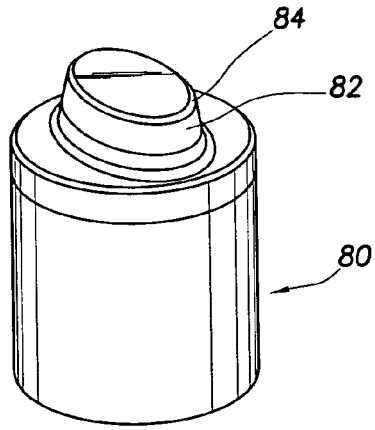
FIG. 4 is a perspective view of another presently preferred embodiment of a PDC insert of the invention.
Figure 5:
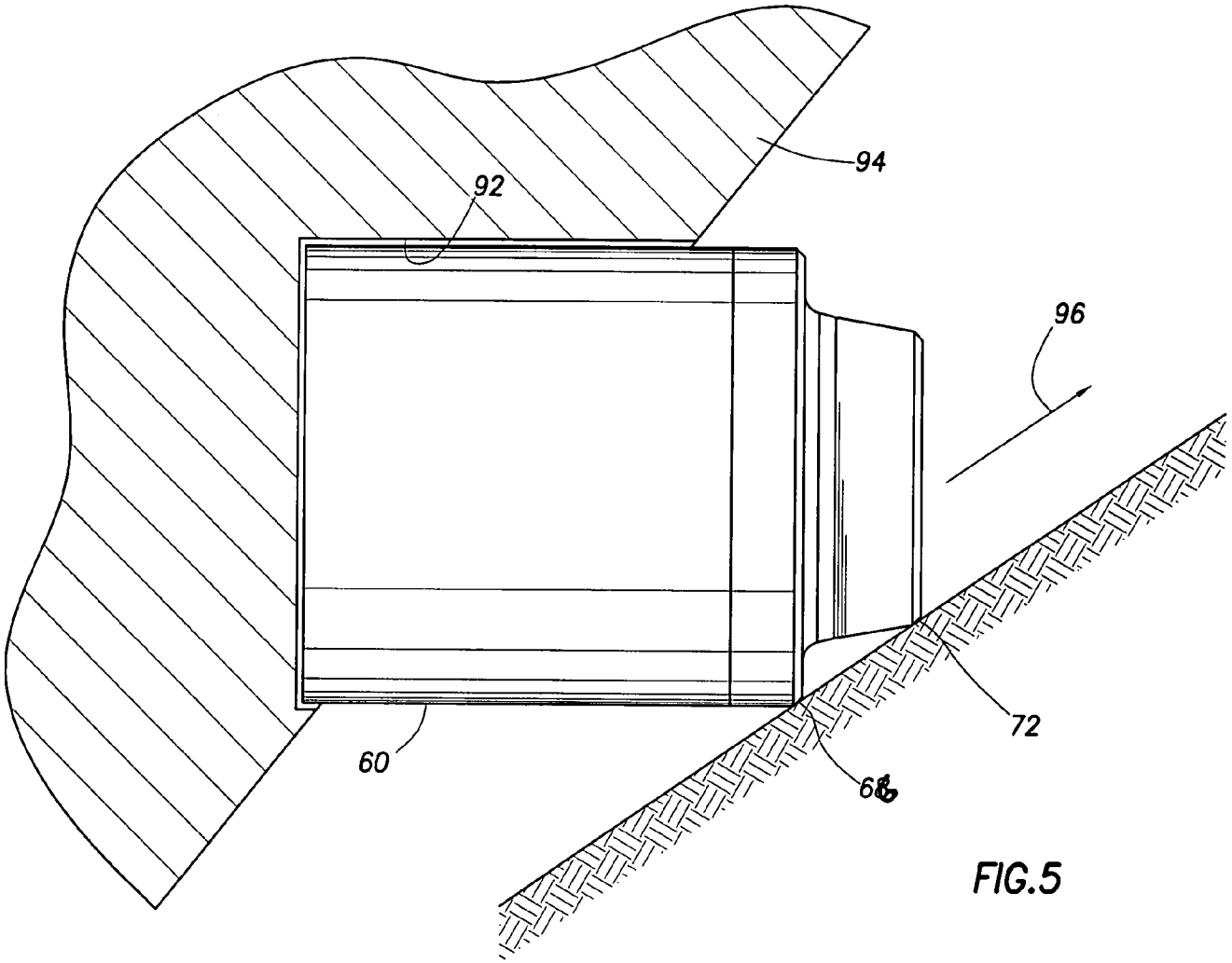
FIG. 5 is a side section view of a PDC insert of the invention as it cuts into a formation.

FIGS. 3, 4, and 5 illustrate the cutter insert of the invention. FIG. 3 shows a cutter insert 60 comprising a plug section 62 and a cutter pedestal 64. The cutter insert 60 is preferably formed of tungsten carbide, except for two exterior surfaces covered with PDC. The plug section, which in FIG. 3 is circular in cross section perpendicular to the axis of the insert, defines a shoulder 66 which is coated with a PDC layer extending part way onto a step or shelf 68. Also, the cutter pedestal section 64 is covered with a PDC layer, which extends part way down onto a slanted wall 70. Thus, the pedestal section also defines a pedestal shoulder 72, covered with PDC. The wall 70 may be slanted to provide a tapered profile for the pedestal section, thereby providing a stronger base for a top surface 74. The plug shoulder 66 and the pedestal shoulder 72 define two distinct cutting surfaces for the cutter insert 60.

FIG. 4 shows another preferred embodiment of a cutter insert 80, which is similar in most respects to the insert illustrated in FIG. 3, except that a pedestal 82 has an oval cross section when taken perpendicular to the axis of the cutter segment. The insert 80 is modestly more expensive to manufacture, but provides the advantage of allowing a pedestal shoulder 84 to cut a narrow, deep leading groove through rock. The geometry of the insert 80 places less work load on the top which initiates the groove, and places more on the lower cutting surface which scrapes away less supported formation on the sides of the initial groove.

FIG. 5 shows how the cutter insert works. A cutter insert 60, constructed as just described, is inserted into a hole 92 in a body 94, preferably a blade in a fixed cutter of FIG. 1 or a reamer of FIG. 2. The shoulders 66 and 72 of the cutter 60 engage the formation at two points. Thus, as the cutter moves across the face of the formation in a direction 96, more material may be worn or chipped away, increasing the speed of the cutter through the formation.

Figure 6A:
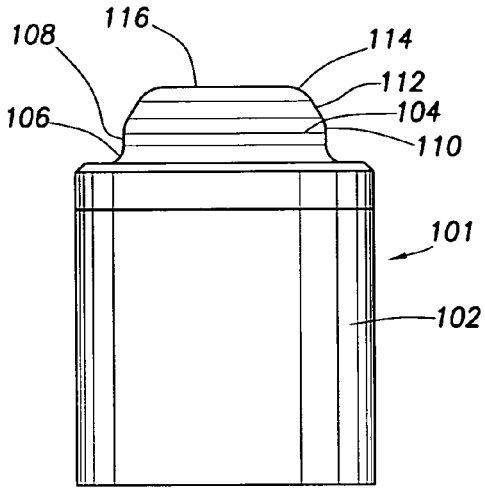
FIG. 6*a* is a side view of a PDC insert of this invention which limits the depth of the cut of the plug.
Figure 6B:
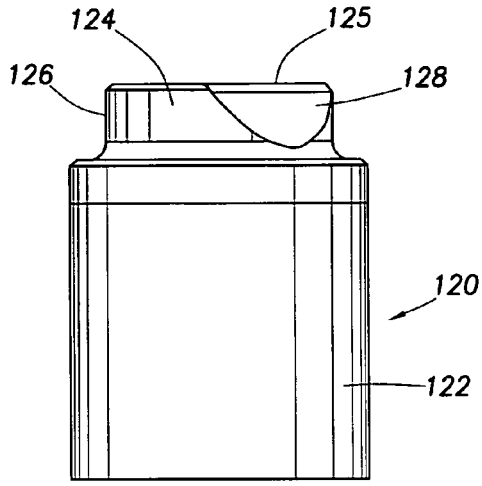
FIG. 6*b* is a side view of another PDC insert which further limits the depth of the cut of the plug.
Figure 6C:
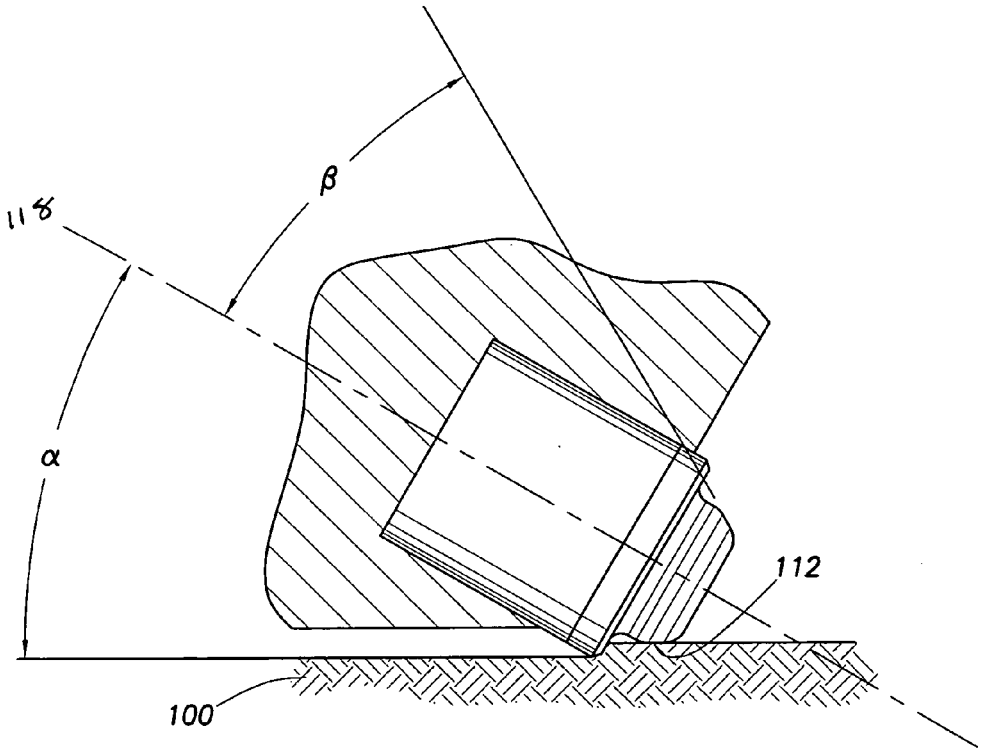
FIG. 6*c* is a side view in partial section, illustrating the depth limiting aspect of this embodiment of the invention.

FIGS. 6*a*, 6*b*, and 6*c* show another preferred embodiment of the invention, in which the degree of embedding into a formation 100 is limited in order to alleviate the problem of stick slip, and to maintain a more constant torque on the bit while drilling in hard formations. In the embodiment of FIG. 6*a*, an insert 101 comprises a plug 102 integrally formed with a pedestal 104, in a manner previously described. A fillet 106 joins the pedestal to the plug to reduce stress cracking at the joint. Then, in ascending order, the pedestal defines a vertical surface 108, a first convex curved surface 110, a straight, frustoconical bevel surface 112, a second convex curved surface 114, and a flat top 116. The bevel surface 112 preferably forms an angle $\beta$ with an axis 118 of the insert 101, as shown in FIG. 6*c*. The bevel angle $\beta$ is also approximately equal to an insert back rake angle $\alpha$, so that the pedestal tends to ride along the surface of the formation 100, rather than digging into it.

Another embodiment which limits the depth of cut is shown in FIG. 6*b*. An insert 120 includes a plug 122 and a pedestal 124. The pedestal 124 defines a circular flat top 125 and a substantially vertical or cylindrical wall 126 in which is formed a large, flat bevel 128. Viewed another way, the bevel 128 defines a surface which cuts across the flat top, thereby forming a chord across the top. The bevel rides against the formation, rather than cutting into it. Thus, as the weight on bit increases, the bevel keeps the insert from digging down into the formation, maintaining a fairly constant torque and reducing the likelihood of stick slip.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A PDC cutter comprising:

a plug;

a pedestal atop the plug;

the pedestal having a side wall and a substantially flat top;

a step between the plug and the pedestal;

wherein the cutter defines an axis, and wherein the pedestal section has an oval cross-section when taken perpendicular to the axis.

2. The PDC cutter of claim 1, further comprising:

a pedestal shoulder connecting the top and the side wall;

a plug shoulder connecting the plug and the step; and the plug shoulder being substantially parallel to the pedestal shoulder.

3. The PDC cutter of claim 1, further comprising:

the step being substantially parallel to the top.

4. The PDC cutter of claim 1, further comprising:

a fillet between the step and the pedestal.

5. The PDC cutter of claim 1, further comprising:

wherein the cutter defines an axis and further wherein the cutter defines a back rake angle, and further wherein the plug shoulder and pedestal shoulders define angles to the axis approximately equal to the back rake angle.

* * * * *